US006205630B1

(12) United States Patent
Mori

(10) Patent No.: US 6,205,630 B1
(45) Date of Patent: Mar. 27, 2001

(54) UNIT OF BUCKLE COMPONENT MEMBERS AND BUCKLE

(75) Inventor: Shinji Mori, Aichi-ken (JP)

(73) Assignee: Kabushiki Kaisha Tokai-Rika-Denki-Seisakusho, Aichi-Ken (JP)

( * ) Notice: Subject to any disclaimer, the term of this patent is extended or adjusted under 35 U.S.C. 154(b) by 0 days.

(21) Appl. No.: 09/428,470

(22) Filed: Oct. 28, 1999

(30) Foreign Application Priority Data

Nov. 2, 1998 (JP) ..... 10-312521

(51) Int. Cl.[7] ..... A44B 11/25
(52) U.S. Cl. ..... 24/633; 24/642; 24/641
(58) Field of Search ..... 24/633, 636, 637, 24/639, 640, 625, 641, 629, 642

(56) References Cited

U.S. PATENT DOCUMENTS 4,621,394 * 11/1986 Wier ..... 24/642
4,624,035 * 11/1986 Wier ..... 24/642
5,067,212 * 11/1991 Ellis ..... 24/633 X
5,377,393 * 1/1995 Ellis ..... 24/641 X

FOREIGN PATENT DOCUMENTS 2-4281 2/1990 (JP) .

* cited by examiner

*Primary Examiner*—Robert J. Sandy
(74) *Attorney, Agent, or Firm*—Nixon Peabody LLP; Thomas W. Cole

(57) ABSTRACT

Before mounting to an anchor plate, a holding block is connected by a plurality of connecting portions to a button so as to be formed integrally with the button. A pair of connecting portions among the plurality of connecting portions is comprised of a button-side connecting portion and a holding block-side connecting portion, and the button-side connecting portion and the holding block-side connecting portions are joined together by a minimum sectional area portion which intersects, at an angle of inclination of 45 degrees, a direction in which the button slides. The minimum sectional area portion is made substantially perpendicular to the direction of tensile stress acting during assembly, and therefore, a crack is formed in the minimum sectional area portion along the shortest possible length of the minimum sectional area portion when the above-described pair of connecting portions is broken. Due to the above-described structure, a unit of buckle component members which can be assembled by a small sliding force and which prevents falling-off of debris during assembly, and a buckle using the unit are obtained.

18 Claims, 8 Drawing Sheets

UNIT OF BUCKLE COMPONENT MEMBERS AND BUCKLE

BACKGROUND OF THE INVENTION

1. Field of the Invention

The present invention relates to a unit of buckle component members and a buckle.

2. Description of the Related Art

FIG. 7 shows a conventional buckle 110 as an example (see Japanese Patent Application Publication (JP-B) No. 2-4281).

In the buckle 110, a lock member guide 114 is mounted on a metal plate 112, and a lock member 116 is moved by the lock member guide 114 between a position where the lock member 116 is engaged with a tongue plate (hereinafter referred to as an engaging position) and a position where it is disengaged from the tongue plate (hereinafter referred to as an engagement-released position). Further, a pressing key 118 is mounted to the metal plate 112 in a slidable manner, and by sliding the pressing key 118, the lock member 116 is moved from the engaging position to the engagement-released position and locking is thereby released.

As shown in FIG. 8, the lock member guide 114 and the pressing key 118 are made integral by being joined together by portions 120 to be broken, before the lock member guide 114 and the pressing key 118 are mounted to the metal plate 112. When the pressing key 118 is slid with side walls 122 of the pressing key 118 being engaged with side edges of the metal plate 112, the lock member guide 114 abuts against the metal plate 112 during the sliding and the sliding is stopped. When the pressing key 118 is slid further, the portions 120 to be broken are sheared due to shearing force acting thereon, and the lock member guide 114 and the pressing key 118 are separated from each other.

However, in the above-described buckle 110, a minimum sectional area portion of the portion 120 to be broken (that is, the portion having the smallest sectional area in an arbitrary cross-section which is either at the portion 120 to be broken or the vicinity thereof) is made parallel to a direction in which the pressing key 118 slides. On the other hand, tensile stress acting on the portion 120 to be broken when the portion 120 is sheared acts obliquely to a direction in which the portion 120 is sheared (that is, the direction in which the pressing key 118 slides), and therefore, the sheared portion is formed along a direction perpendicular to the tensile stress so as to intersect the direction in which the pressing key 118 slides. For this reason, the portion 120 to be broken is not broken along the minimum sectional area portion and the sectional length of the portion which is actually broken becomes longer. Therefore, a breaking force greater than necessary, that is, a force for sliding the pressing key 118, becomes necessary. Further, when the broken portion and the minimum sectional area portion do not coincide with each other as described above, broken portions are formed in plural places and members disposed between the broken portions are sometimes separated from both of the lock member guide 114 and the pressing key 118 and fall off. In this case, it is necessary to remove, by suction or sweeping, the pieces which have fallen off, thereby resulting in an increase in the number of manufacturing processes.

SUMMARY OF THE INVENTION

In view of the above-described facts, an object of the present invention is to provide a unit of buckle component members and a buckle which can be assembled with a small sliding force and in which there are no pieces which fall off during assembly.

In order to achieve the above-described object, in a first aspect of the present invention, there is provided a unit of buckle component members, comprising: plural members which are formed integrally with each other and are provided so as to be mounted to a buckle main body by sliding the plural members with respect to the buckle main body; and connecting portions by which the plural members are connected together to form an integrated main body of the unit of buckle component members and which respectively include minimum sectional area portions each intersecting a direction in which the main body of the unit of buckle component members slides with respect to the buckle main body.

In a state in which the main body of the unit of buckle component members is slid with respect to the buckle main body and some of the members which form the main body of the unit of buckle component members are fixed to the buckle main body, when the main body of the unit of buckle component members is slid further, the fixed member and a member which is being slid become offset from each other and tensile stress acts on the connecting portions obliquely to a direction of shearing (the sliding direction). The connecting portions each include a minimum sectional area portion disposed along a direction which intersects the sliding direction. The connecting portions are each pulled from both sides of the minimum sectional area portion by the shearing force, and therefore, a crack is formed in the minimum sectional area portion along the shortest possible length of the minimum sectional area portion. According to the first aspect of the present invention, since the minimum sectional area portion is thus broken, a small force suffices for causing the breakage, that is, for the sliding when the main body of the unit of buckle component members is assembled to the buckle main body.

Further, since the breakage is caused in the minimum sectional area portion, the breakage does not occur at plural places. Accordingly, there is no possibility of pieces falling off during assembly.

In accordance with a second aspect of the present invention, the minimum sectional area portions each intersect a sliding direction of the main body of the unit of buckle component members at an angle of intersection in the range of 40 to 50 degrees such that each minimum sectional area portion extends substantially perpendicular to the direction of tensile stress acting on the connecting portions due to the sliding of the main body of the unit of buckle component members.

Generally, the tensile stress applied to the connecting portions acts in a direction which is inclined at an angle of about 45 degrees with respect to the direction of shearing (the sliding direction). Accordingly, according to the second aspect of the present invention, the minimum sectional area portion is made to intersect the sliding direction at an angle of 40 to 50 degrees, so as to allow the tensile stress applied to the connecting portions to be made substantially perpendicular to the minimum sectional area portions. As a result, the breakage can be effectively caused in the minimum sectional area portions.

A third aspect of the present invention is a buckle comprising: a holding member for holding a lock member, which is engaged with a tongue plate inserted up to a predetermined position so as to make it impossible to pull but the tongue plate, such that the lock member is movable between a position where the lock member is engaged with the tongue plate and a position where the engagement of the lock member and the tongue plate is released; a release operating member which operates the lock member engaged with the tongue plate so as to move the lock member in an engagement releasing direction; and a mounting member to which the holding member is fixed and to which the release operating member is mounted in a slidable manner, wherein, before the holding member and the release operating member are assembled with the mounting member, the holding member and the release operating member are integrally connected via connecting portions, to thereby form a unit of buckle component members which can be mounted to the mounting member by sliding with respect to the mounting member, and the connecting portions respectively include minimum sectional area portions which are each formed along a direction which intersects the sliding direction of the unit of buckle component members.

In this type of buckle, the lock member is engaged with the tongue plate inserted up to a predetermined position so that the tongue plate cannot be pulled out (a locked state). When the release operating member is operated in the locked state, the lock member engaged with the tongue plate is moved to an engagement released position, the engagement of the lock member and the tongue plate is released, and the tongue plate can be pulled out.

The holding member, which holds the lock member, and the release operating member are integrally connected by the connecting portions before being assembled to the mounting member, and form a unit of buckle component members. In the state in which the unit of buckle component members is slid with respect to the mounting member and the holding member is fixed to the mounting member, when the unit of buckle component members is slid further, the holding member and the release operating member become offset from each other and tensile stress acts on the connecting portions obliquely to the direction of shearing (the sliding direction).

According to the third aspect of the present invention, the connecting portions each include a minimum sectional area portion disposed along a direction which intersects the sliding direction, and the breakage is caused in the minimum sectional area portion along the shortest possible length of the minimum sectional area portion in such a manner that the connecting portion is pulled from both sides of the minimum sectional area portion by the shearing force. The breakage is thus reliably caused in the minimum sectional area portion along the shortest possible length of the minimum sectional area portion, and therefore, a small force suffices for causing the breakage, that is, for the sliding of the unit of buckle component members with respect to the mounting member during assembly. Accordingly, manufacturing of the buckle is facilitated.

Further, a crack occurs only in the minimum sectional area portion and does not occur in plural places. Accordingly, the possibility of debris being generated by the breakage during assembly is much lower. As a result, a process for removing broken pieces becomes substantially unnecessary, and therefore, manufacturing of the buckle is facilitated.

DESCRIPTION OF THE PREFERRED EMBODIMENTS

Figure 1:
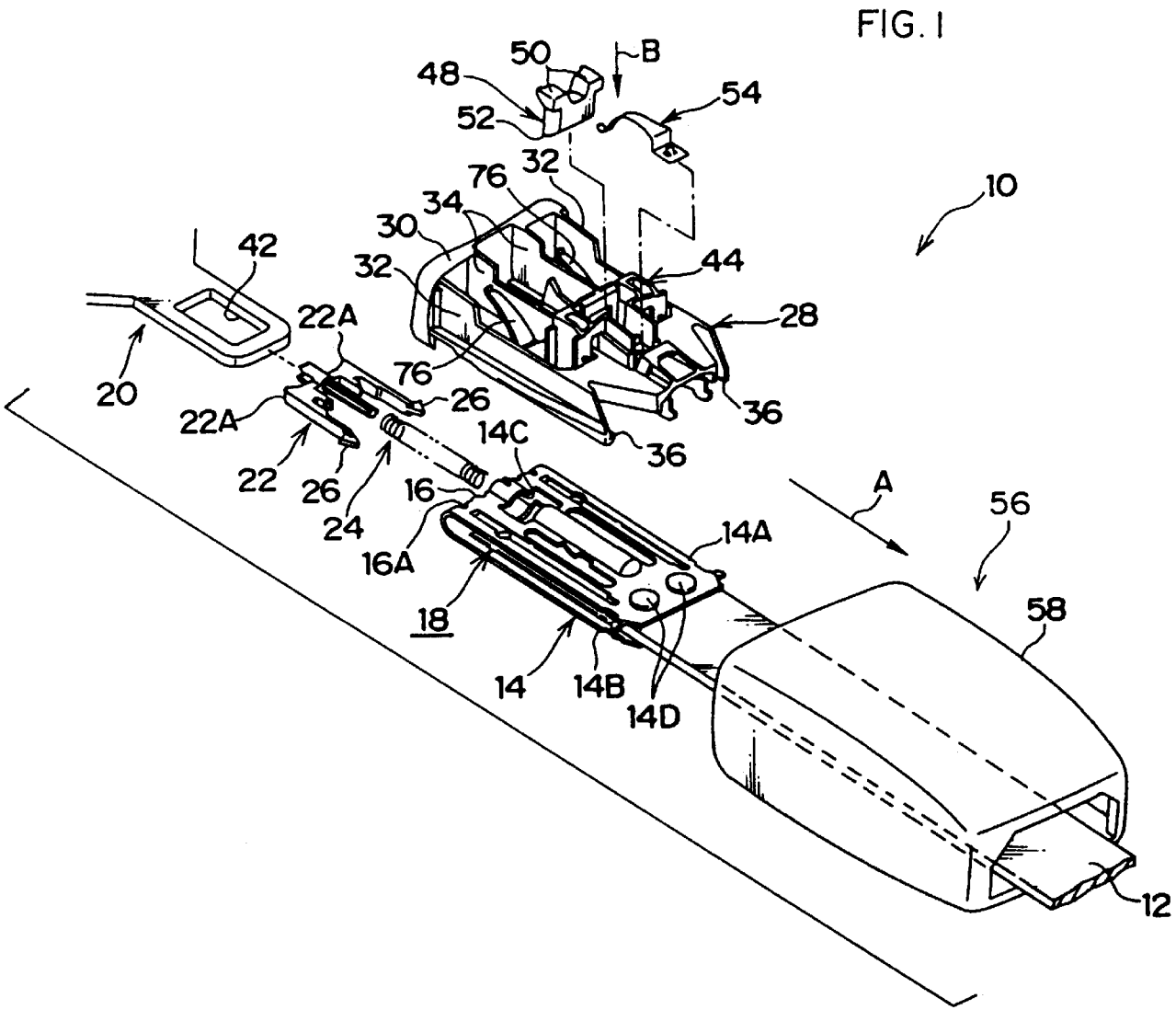
FIG. 1 is an exploded perspective view which shows a buckle according to an embodiment of the present invention.

FIG. 1 shows a buckle 10 according to an embodiment of the present invention.

The buckle 10 has an anchor plate 14 which is mounted by rivets 14D to a mounting piece 12 extending from a vehicle (not shown). The anchor plate 14 is formed by folding an elongated plate material at the center thereof in the longitudinal direction and is comprised of two parallel plates (an upper plate 14A and a lower plate 14B) with a predetermined clearance formed therebetween. An insertion hole 16 is formed at the center of one end (a folded portion) of the anchor plate 14 and a tongue plate 20 is inserted from the insertion hole 16 into an insertion portion 18 formed between the upper plate 14A and the lower plate 14B. A through hole (not shown) is formed in the tongue plate 20 and a webbing of a seat belt device is inserted through the through hole. Further, the mounting piece 12 is inserted from the other end of the anchor plate 14 and fixed by the above-described rivets 14D.

An ejector 22 is accommodated within the anchor plate 14 in a slidable manner along a longitudinal direction of the anchor plate 14 (the direction indicated by arrow A and the direction opposite thereto). An ejection spring 24 is disposed between the ejector 22 and the mounting piece 12 and urges the ejector 22 toward the insertion hole 16 (in the direction opposite to that indicated by arrow A). Sliding movement of the ejector 22 is limited in a predetermined range due to corner portions 22A of the ejector 22 abutting the anchor plate 14.

A pair of angular pieces 26 facing the mounting piece 12 are protruded from both ends in the transverse direction of the ejector 22. A projecting portion provided in each of the angular portions 26 substantially at the center in the longitudinal direction of the angular portion 26 is formed at a predetermined position so as to press a projection (not shown) provided in a button 28 when the ejector 22 is pushed by the tongue plate 20 and moves toward the mounting piece 12 (in the direction indicated by arrow A).

The button 28 is mounted at the side of the upper plate 14A of the anchor plate 14. The button 28 is formed substantially in the shape of a rectangular frame when seen from above and includes a pressing plate 30 for a pressing operation, a pair of parallel outer plates 32 protruded from the vicinities of the transverse-direction ends of the pressing plate 30, and a pair of parallel inner plates 34 protruded from the pressing plate 30 further at a transverse-direction inner side of the pressing plate 30 than the outer plates 32.

A claw piece 36 is formed in each of the outer plates 32 so as to face inward. The claw piece 36 is engaged between the upper plate 14A and the lower plate 14B of the anchor plate 14 from the outer side of the anchor plate 14, so that the button 28 cannot be disengaged from the anchor plate 14 and is slidable along the longitudinal direction of the anchor plate 14 (the direction indicated by arrow A and the direction opposite thereto).

A protrusion (not shown) is formed on each of inner surfaces of the inner plates 34. In a state in which the tongue plate 20 is not inserted into the insertion portion 18, the protrusion abuts lower surfaces of abutment pieces 50 of a latch 48 (described later), and movement of the latch 48 in the engaging direction (that is, the direction indicated by arrow B) is thereby prevented. Further, in a state in which the tongue plate 20 is inserted into the insertion portion 18 and the latch 48 is engaged with an engagement hole 42 of the tongue plate 20 (a locked state), the protrusion abuts upper surfaces of the abutment pieces 50 of the latch 48, and movement of the latch 48 in the engagement releasing direction (that is, the direction opposite to that indicated by arrow B) is prevented.

When the button 28 is pushed and moved in a direction in which locking is released (that is, the direction indicated by arrow A) in the locked state, the above-described protrusion (not shown) which prevents movement of the latch 48 in the direction indicated by arrow B is moved apart from the abutment pieces 50. Further, the pressing force on the button 28 is converted to a force for moving the latch 48 in the engagement releasing direction (that is, the direction opposite to that indicated by arrow B) by a release surface (not shown) formed in each of the inner plates 34. As a result, the latch 48 is pushed to be moved in the engagement releasing direction.

A holding block 44 is provided upright on the upper plate 14A at a position which is further inward than the outer plates 32 of the button 28 in such a manner as to straddle the inner plates 34. A pair of leg portions 60 (see FIG. 2) are formed in the holding block 44 so as to protrude downward. In a state in which the holding block 44 is mounted to the upper plate 14A, the leg portions 60 are engaged with engagement concave portions 16A formed at the transverse-direction ends of the insertion hole 16 so as to prevent the sliding in the direction indicated by arrow A.

The latch 48 is disposed within the holding block 44. The movement of the latch 48 along the longitudinal direction of the anchor plate 14 (the direction indicated by arrow A and the direction opposite thereto) is prevented by the holding block 44. However, the latch 48 can be moved in the engaging direction and in the engagement releasing direction (that is, the direction indicated by arrow B and the direction opposite thereto). In the state before the holding block 44 is mounted to the anchor plate 14, the holding block 44 is connected to the button 28 by a plurality of connecting portions 62, 64, and 66 (see FIGS. 2 and 3) so as to be integrated with the button 28, which will be described later in detail.

The latch 48 is formed so as to have a substantially U-shaped configuration when seen from front and includes the abutment pieces 50 extending from the upper end of the latch 48 outwardly in the transverse direction of the latch 48. An engaging piece 52 extends from the center of the latch 48 in the transverse direction thereof toward the tongue plate 20. When the tongue plate 20 is inserted into the insertion portion 18 to a predetermined position, the engaging piece 52 passes through a through hole 14C formed in the upper plate 14A of the anchor plate 14 and further passes through a through hole (not shown) formed in the lower plate 14B.

A pair of plate spring pieces 76 are formed in the holding block 44 in such a manner as to project toward the pressing plate 30 of the button 28, and urges the button 28 in the direction opposite to the direction indicated by arrow A. Due to this, when the pressing plate 30 is pressed, moderate resistance is generated.

One end of a plate spring-shaped lock spring 54 is mounted to the button 28. Another end of the lock spring 54 abuts the upper surface of the latch 48 and urges the latch 48 in the engaging direction (that is, the direction indicated by arrow B).

In short, a buckle main body 56 of the present invention is formed by the anchor plate 14, the ejector 22, the ejection spring 24, the latch 48, and the lock spring 54, which are all described above.

A cover 58 is attached to the buckle main body 56 such that the anchor plate 14, the ejector 22, the ejection spring 24, the holding block 44, the latch 48, and the lock spring 54 are covered. The cover 58 is formed to have a rectangular pipe-shaped configuration in which longitudinal-directional ends thereof are open. The cover 58, accommodating the mounting piece 12 put through inside it, is slid from the other end side of the mounting piece 12 to a position at which the cover 58 covers the buckle main body 56 and a fixing protrusion (not shown) of the anchor plate 14 is engaged with the cover 58 so that the cover 58 does not come off.

Figure 2:
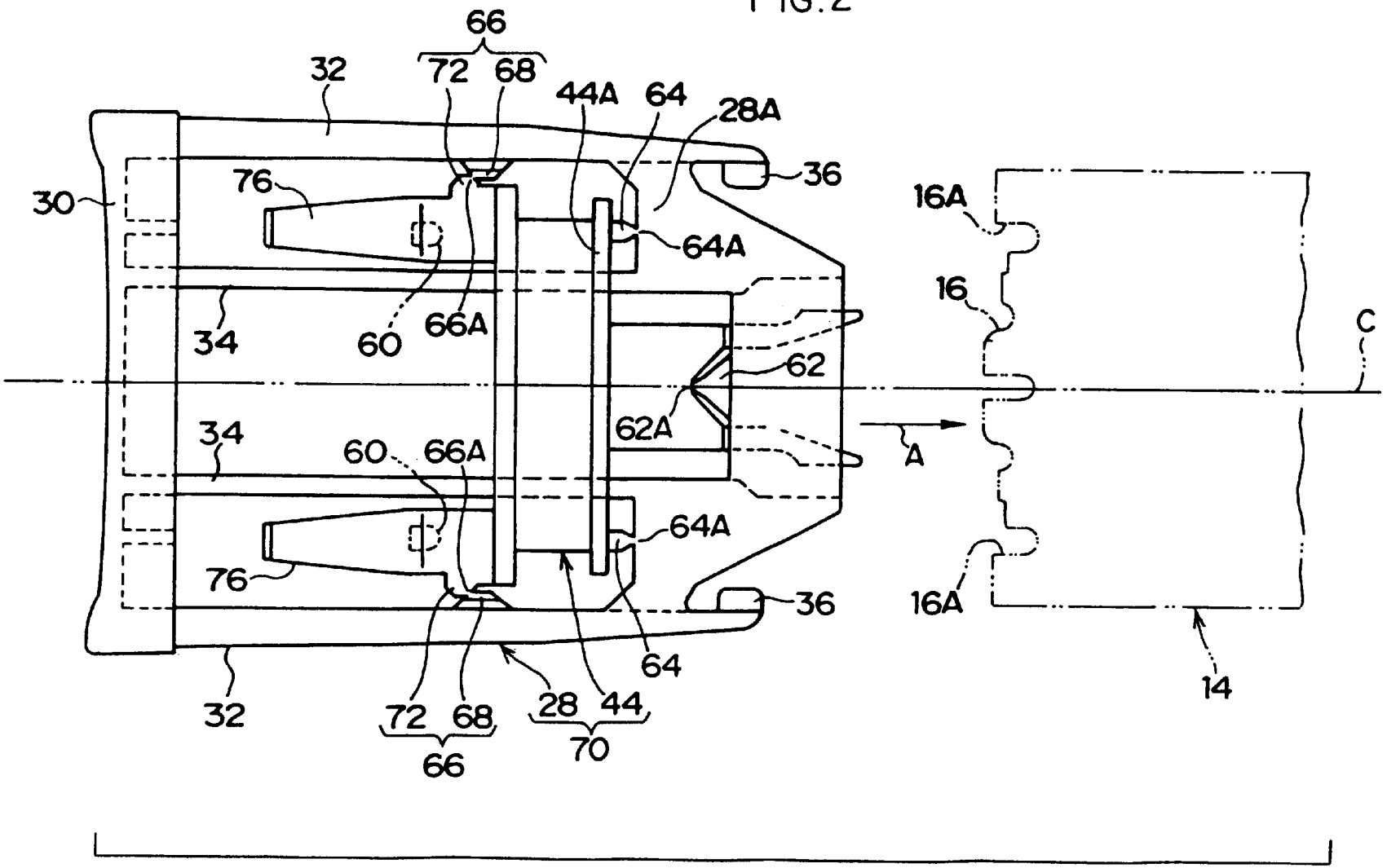
FIG. 2 is a plan view which shows a unit of buckle component members of the buckle according to the embodiment of the present invention.
Figure 3:
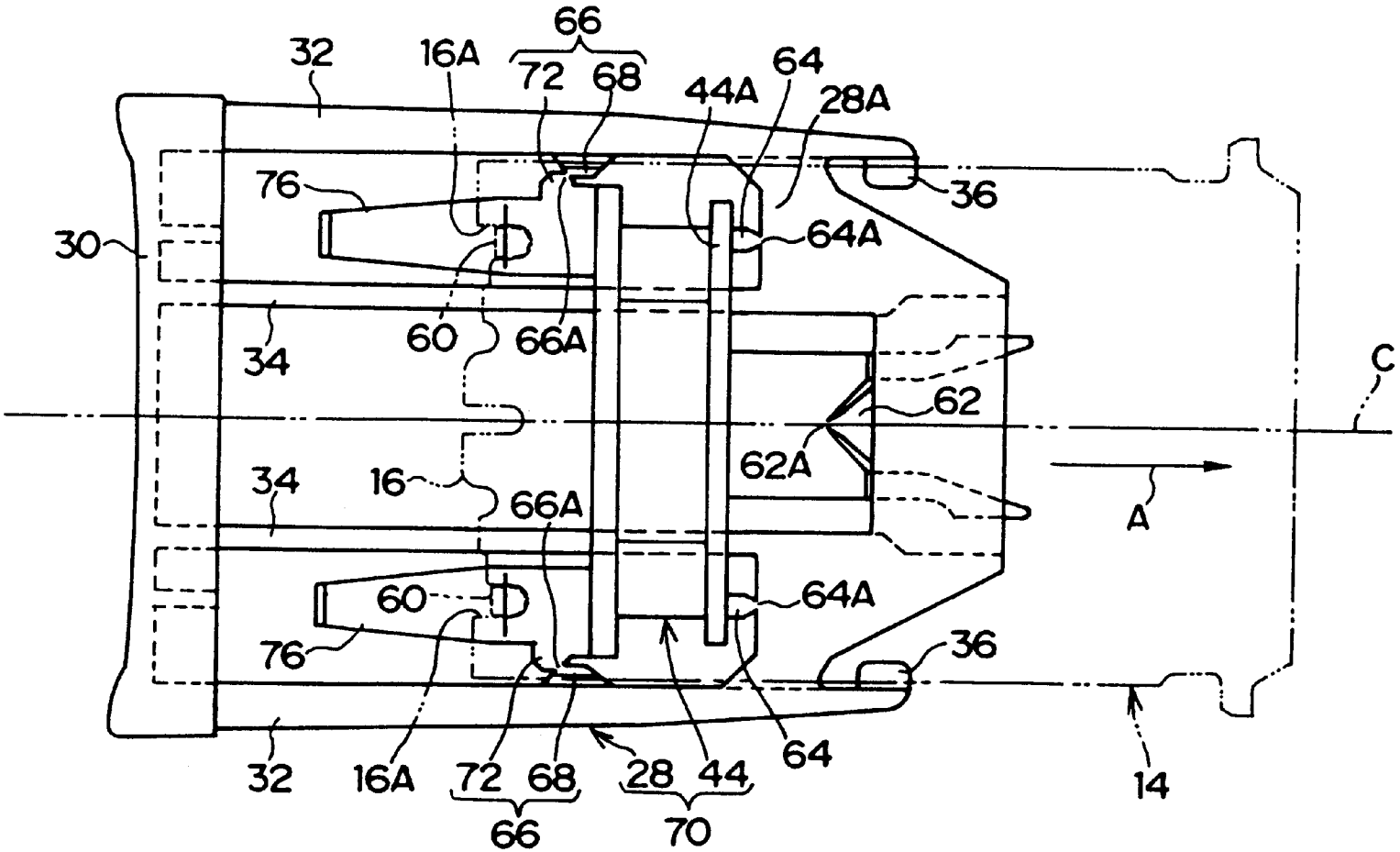
FIG. 3 is a plan view which shows a state in which the unit of buckle component members of the buckle according to the embodiment of the present invention is slid with respect to an anchor plate.

As shown in FIGS. 2 and 3, the button 28 and the holding block 44 are joined together by the plurality of connecting portions 62, 64, and 66 in a state before they are mounted to the anchor plate 14, thereby forming an integrated unit 70 of buckle component members. More specifically, the unit 70 of buckle component members includes a main body of the unit of buckle component members (the main body is comprised of the button 28 and the holding block 44 in the illustrated structure), and also includes the connecting portions 62, 64, and 66 for connecting the button 28 and the holding block 44. The unit 70 of buckle component members is bisymmetrical with respect to the center line C which is a virtual axis of symmetry.

The connecting portion 62 is located on the center line C of the unit 70 of buckle component members and is formed so that a minimum sectional area portion 62A is disposed in a direction perpendicular to the directions in which the button 28 slides (the direction indicated by arrow A and the direction opposite thereto).

Further, the connecting portions 64 are located at positions which are bisymmetrical to each other with respect to the center line C as the center line in the widthwise direction and are each protruded from a rear wall 44A of the holding block 44 so as to have a substantially pentagonal shape in the plan view. The protruded ends of the connecting portions 64 are formed continuously with a rear wall 28A of the button 28 and each form a minimum sectional portion 64A which faces in a direction perpendicular to the directions in which the button 28 slides (the direction indicated by arrow A and the direction opposite thereto).

Figure 4:
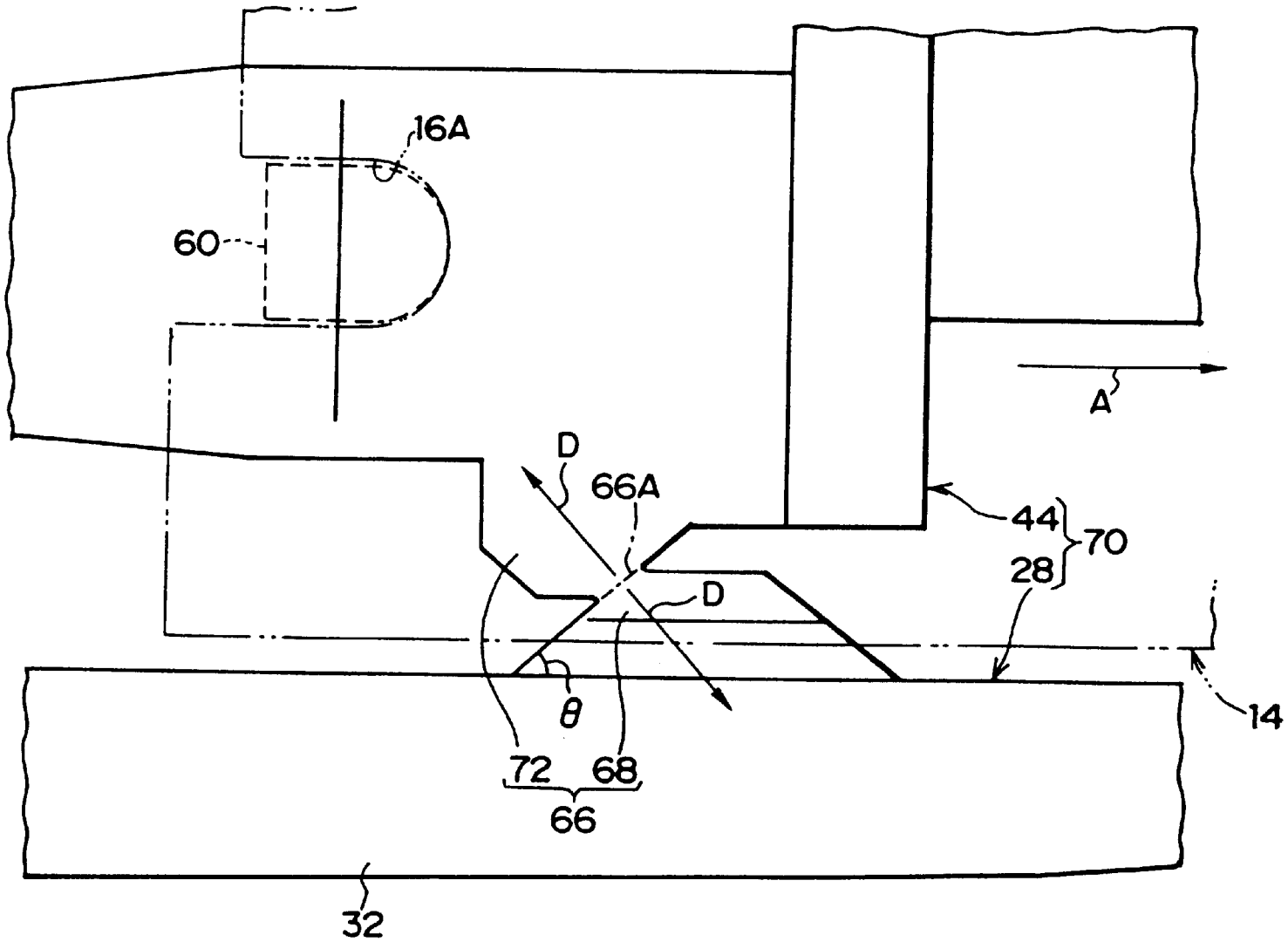
FIG. 4 is a plan view which shows one of connecting portions shown in FIG. 3 and its vicinity in an enlarged state.

As shown in FIG. 4 in detail, the connecting portions 66 are located at positions which are bisymmetrical to each other with respect to the center line C as the center line in the widthwise direction. Each of the connecting portions 66 is comprised of a button-side connecting portion 68 and a holding block-side connecting portion 72 which are each substantially in a trapezoidal shape. The button-side connecting portion 68 is formed in the outer plate 32 of the button 28 so as to project toward the holding block 44 and the holding block-side connecting portion 72 is formed in the vicinity of a portion of the plate spring piece 76 at which portion the plate spring piece 76 is attached to the holding block 44 so as to project toward the outer plate 32. The holding block-side connecting portion 72 is formed at a position further displaced toward the press plate 30 than the button-side connecting portion 68. The button-side connecting portion 68 and the holding block-side connecting portion 72 are formed continuously with each other in such a manner that oblique lines of respective trapezoidal shapes thereof are partially shared with each other. The portion at which these connecting portions 68 and 72 are joined together forms a minimum sectional area portion 66A (indicated by the one-dot chain line in FIG. 4) which intersects the directions in which the button 28 slides (the direction indicated by arrow A and the direction opposite thereto) at an angle θ of inclination (θ=45°).

Next, a method for manufacturing the buckle 10 by mounting the unit 70 of buckle component members according to the present embodiment to the anchor plate 14, and operation of the buckle 10 will be described.

First, prior to the unit 70 of buckle component members being mounted to the anchor plate 14, the ejection spring 24 and the ejector 22 are disposed within the anchor plate 14.

Figure 5:
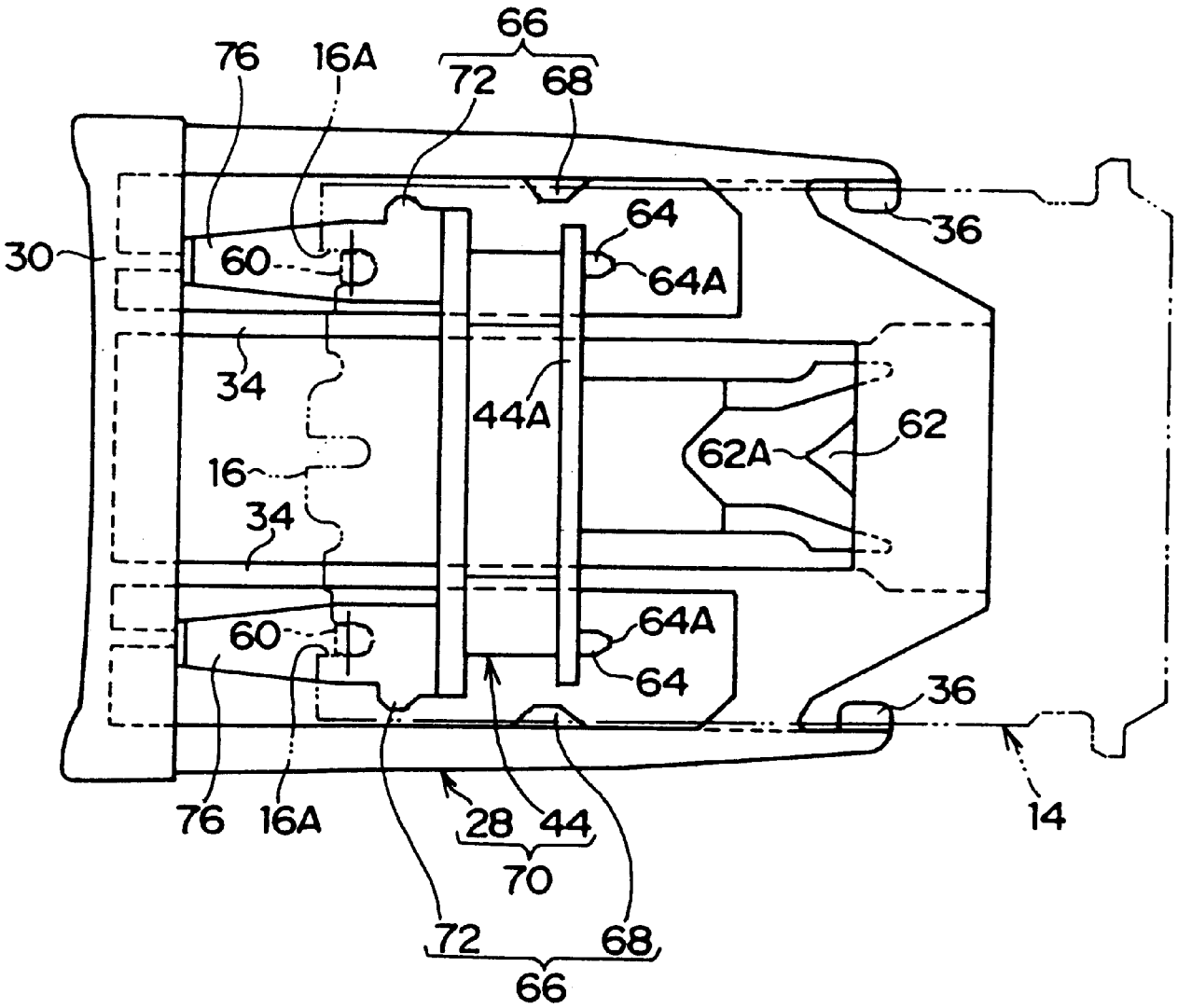
FIG. 5 is a plan view which shows a state in which a connection structure of the unit of buckle component members according to the embodiment of the present invention has been broken.

In order that the unit 70 of buckle component members be mounted to the anchor plate 14, first, the claw pieces 36 protruded from the outer plates 32 of the button 28 are inserted from the insertion hole 16 of the anchor plate 14 so as to be engaged between the upper plate 14A and the lower plate 14B. In this state, the entire unit 70 of buckle component members is pushed and slid in the direction indicated by arrow A. During the sliding movement, the leg pieces 60 protruding from the holding block 44 are engaged with the engagement concave portions 16A of the insertion hole 10, and therefore, the sliding movement of the holding block 44 in the direction indicated by arrow A is blocked. When only the button 28 is pressed, tensile force acts on the connecting portions 62 and 64. The minimum sectional portions 62A and 64A of the connecting portions 62 and 64 are each made perpendicular to the direction in which the button 28 slides (the direction indicated by arrow A). Therefore, as shown in FIG. 5, the connecting portions 62 and 64 are each pulled from the both sides of each minimum sectional area portions 62A and 64A and are each broken in the minimum sectional area portions 62A and 64A along the shortest possible length of each minimum sectional area portion.

Figure 6:
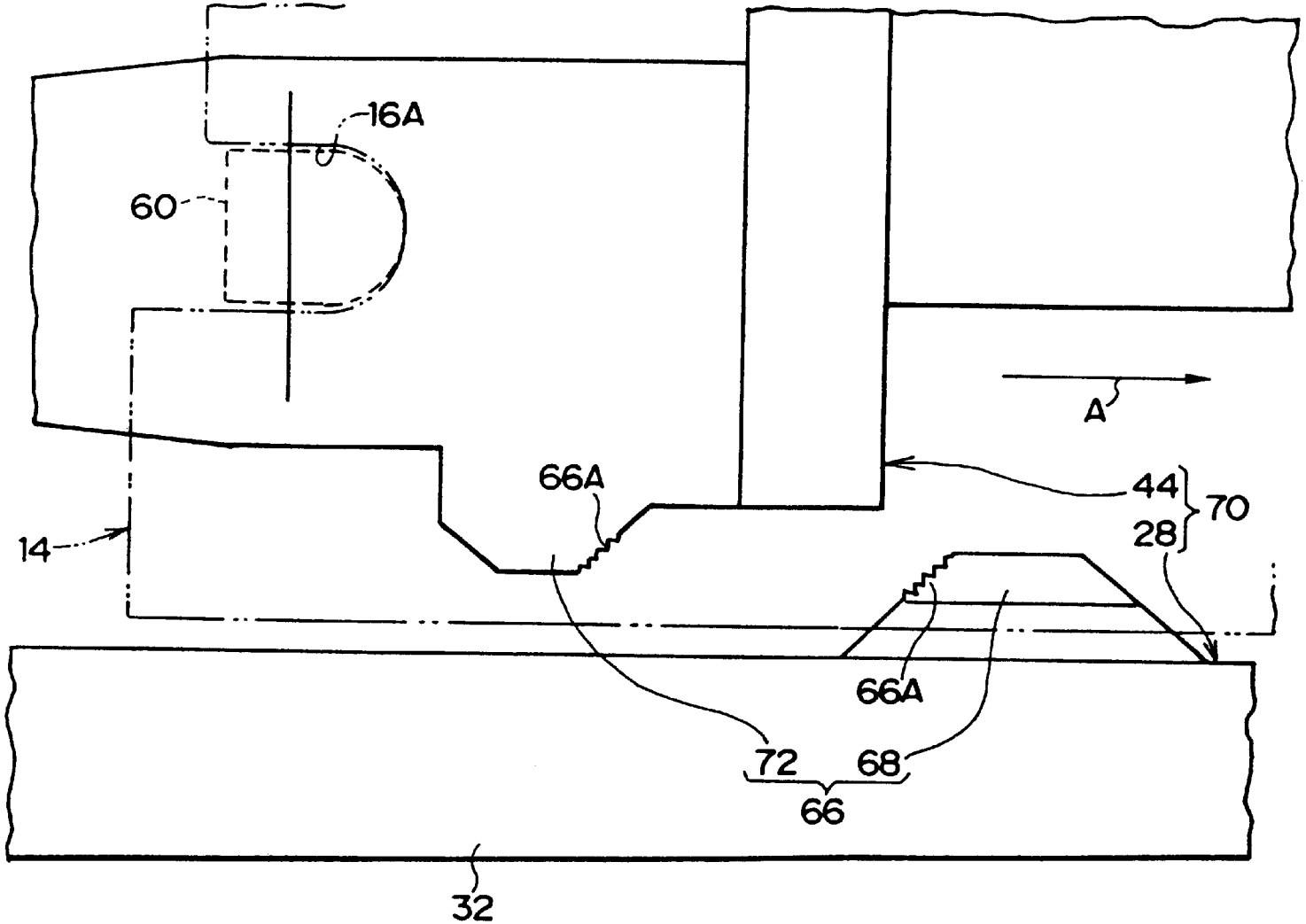
FIG. 6 is a plan view which shows one of connecting portions shown in FIG. 5 and its vicinity in an enlarged state.
Figure 7:
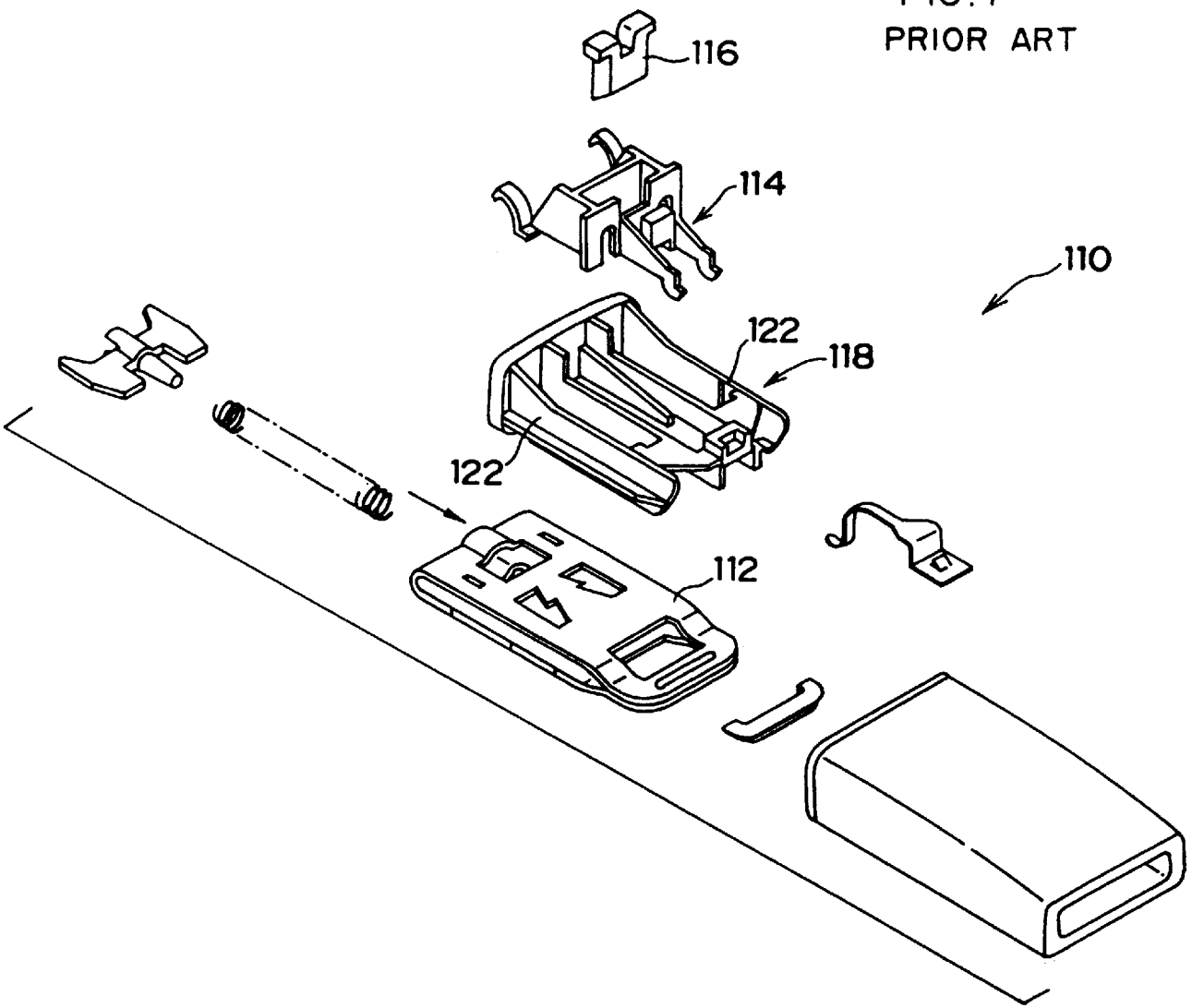
FIG. 7 PRIOR ART
FIG. 7 is an exploded perspective view of a conventional buckle.
Figure 8:
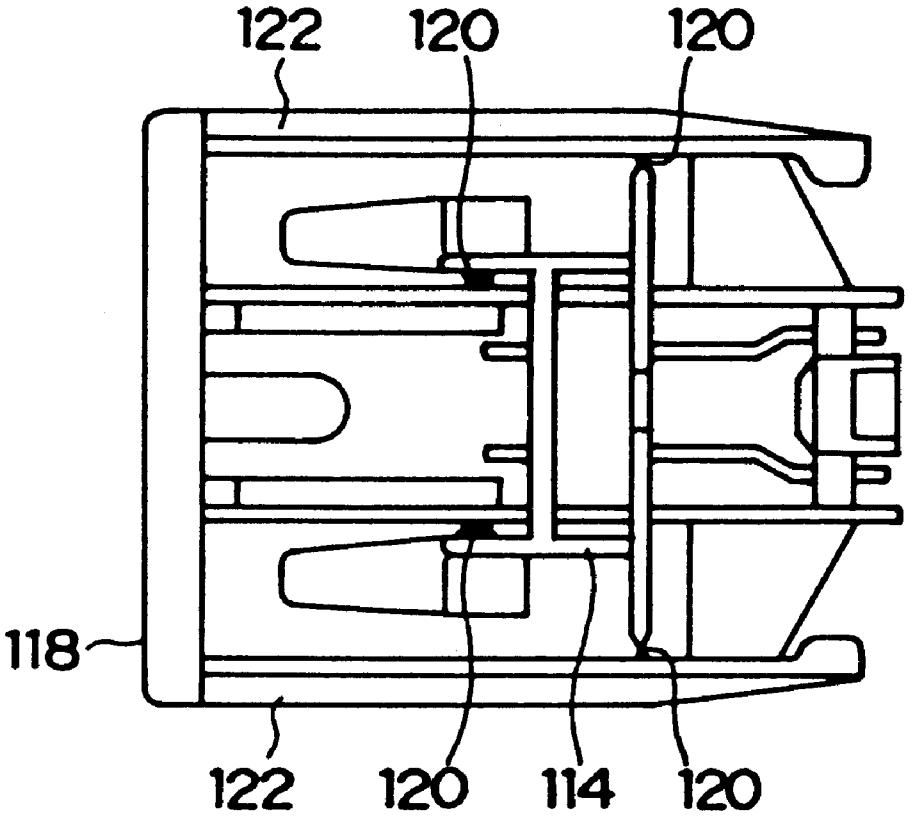
FIG. 8 PRIOR ART
FIG. 8 is a plan view which shows a unit of buckle component members of the conventional buckle.

On the other hand, as shown in FIG. 4, shearing forces of the direction of the sliding movement and the direction opposite thereto act on the button-side connecting portion 68 and the holding block-side connecting portion 72, which connecting portions form the connecting portion 66. Due to the shearing forces, tensile stress acts on the minimum sectional area portion 66A of the connecting portion 66 in the directions indicated by arrows D (the directions inclined with respect to the direction of the sliding movement at an angle θ of about 45 degrees). As the minimum sectional area portion 66A intersects the direction of the sliding movement at an angle of inclination of about 45 degrees and is disposed along a direction substantially perpendicular to the tensile stress, the button-side connecting portion 68 and the holding block-side connecting portion 72 are pulled from both sides of the minimum sectional area portion 66A. As a result, as shown in FIGS. 5 and 6, a crack is formed in the minimum sectional area portion 66A along the shortest possible length of the minimum sectional area portion and the connecting portion 66 is thereby effectively broken.

As described above, the connecting portion 66 is broken in the minimum sectional area portion 66A along the shortest possible length of the minimum sectional area portion, and therefore, as compared with cases in which other portions are broken, a length (distance) of breakage is made shortest. Accordingly, small force suffices for the breakage, that is, for the sliding of the button 28 and mounting of the unit 70 of buckle component members to the anchor plate 14 is facilitated (quick and easy assembly).

Further, since the breakage occurs in the minimum sectional area portion 66A along the shortest possible length of the minimum sectional area portion, breakage in other portions than the above can be reliably prevented. Namely, the breakage reliably occurs only at one portion and does not occur at plural portions. Therefore, there is substantially no possibility of debris falling off due to the breakage. As a result, the process for removing fallout debris becomes unnecessary and manufacturing of the buckle 10 becomes further facilitated.

In such a manner as described above, the holding block 44 is separated from the button 28, and at the same time, the holding block 44 is fixed to the anchor plate 14 and the button 28 is mounted to the anchor plate 14 such that the button 28 can be slid in the direction indicated by arrow A and in the direction opposite thereto.

Then, the latch 48 is accommodated in the holding block 44 and the lock spring 54 is mounted at the button 28. Finally, the cover 58 is installed and the buckle 10 is thereby completed.

In the completed buckle 10, in a state in which the tongue plate 20 is not inserted into the insertion hole 16, the movement of the latch 48 in the engaging direction (the direction indicated by arrow B) is blocked by the projection (not shown) formed in the button 28.

When the tongue plate 20 is inserted into the insertion hole 16, the button 28 is slid in the direction indicated by arrow A via the ejector 22. Therefore, the projection (not shown) formed in the button 28 is moved away from the latch 48 and the latch 48 is urged by the lock spring 54 in the engaging direction (the direction indicated by arrow B). When the tongue plate 20 is further inserted so that the engagement hole 42 reaches the latch 48, the latch 48 is further moved in the engaging direction (the direction indicated by arrow B) and the engaging piece 52 is engaged with the engagement hole 42. As a result, the tongue plate 20 cannot be pulled out from the insertion hole 16 and is thereby locked.

In the locked state, when the pressing plate 30 of the button 28 is pressed and the button 28 is slid in a locking releasing direction (the direction indicated by arrow A), the latch 48 is moved upward against the urging force of the lock spring 54 and is disengaged from the engagement hole 42 of the tongue plate 20. The tongue plate 20, receiving the urging force of the ejection spring 24 via the ejector 22, comes out from the insertion portion 18.

In the foregoing, there was described a case in which the button 28 and the holding block 44 are made integrally to form the unit 70 of buckle component members, but the unit of buckle component members according to the present invention is not limited to the same. Namely, among a plurality of component members which form the buckle 10, members which are displaced to offset positions to each other due to sliding and then separated from each other by shearing force acting on a connecting portion during assembling onto the anchor plate 14 (the buckle main body 56) can be joined together, by any possible combination, by the above-mentioned connecting portion 66 to form the unit of buckle component members of the present invention.

Further, the minimum sectional area portion 66A of the connecting portion 66 are not necessarily to be inclined with respect to the sliding directions (the direction indicated by arrow A and the direction opposite thereto) at an angle of about 45 degrees. This angle of inclination may have other values as long as the minimum sectional area portion 66A extends substantially perpendicular to the direction of the tensile stress acting on the connecting portion 66. However, the tensile force generally acts in the direction which is inclined to the sliding direction at an angle of about 45 degrees as shown in FIG. 4, and therefore, the angle θ of inclination (shown in FIG. 4) of the minimum sectional area portion 66A is preferably set such that $40° \leqq \theta \leqq 50°$.

What is claimed is:

1. A unit of buckle component members, comprising:

plural members which are formed integrally with each other and are provided so as to be mounted to a buckle main body by sliding the plural members along an axis (A) with respect to the buckle main body; and connecting portions by which said plural members are connected together to form a integrated main body of the unit of buckle component members and which respectively include minimum sectional area portions formed along a line that transversely intersects said axis (A) in which the main body of the unit buckle component members slides with respect to the buckle main body.

2. A unit of buckle component members according to claim 1, wherein said unit of buckle component members is formed so as to be symmertrical about a longitudinal-direction center line thereof.

3. A unit of buckle component members according to claim 2, wherein said line along which the minimum sectional area portions are formed each transversely intersects said axis (A) of said sliding direction of the main body of the unit of buckle component members at an angle of intersection in the range of about 40 to 50 degrees such that each minimum sectional area portion extends substantially perpendicular to a direction of tensile stress acting on said connecting portions due to the sliding of the main body of the unit of buckle component members.

4. A unit of buckle component members according to claim 2, wherein said plural members mounted to the buckle main body comprise:

a holding member for holding a lock member, which is engaged with a tongue plate inserted up to a predetermined position so as to make it impossible to pull out the tongue plate, such that the lock member is movable between a position where the lock member is engaged with the tongue plate and a position where engagement of the lock member and the tongue plate is released; and a release operating member which operates the lock member engaged with the tongue plate so as to move the lock member in an engagement releasing direction, wherein said connecting portions by which said holding member and said release operating member are connected integrally include a first connecting portion positioned on the longitudinal-direction center line of said unit of buckle component members, a pair of second connecting portions provided at positions which are symmetrical about the center line, and a pair of third connecting portions provided at positions which are symmetrical about the center line.

5. A unit of buckle component members according to claim 4, wherein a minimum sectional area portion of the first connecting portion is formed so as to face in a direction perpendicular to a direction in which said release operating member slides.

6. A unit of buckle component members according to claim 4, wherein minimum sectional area portions of the second connecting portions are formed so as to face in a direction perpendicular to a direction in which said release operating member slides.

7. A unit of buckle component members according to claim 4, wherein minimum sectional area portions of the third connecting portions are provided to face in a direction which intersects, at a fixed angle of inclination, a direction in which said release operating member slides.

8. A unit of buckle component members according to claim 7, wherein the fixed angle of inclination is set so that the minimum sectional area portions of the third connecting portions are provided to face in a direction substantially perpendicular to tensile stress acting on the third connecting portions.

9. A unit of buckle component members according to claim 8, wherein the fixed angle of inclination is 45 degrees.

10. A buckle comprising:

a holding member for holding a lock member, which is engaged with a tongue plate inserted up to a predetermined position so as to make it impossible to pull out the tongue plate, such that the lock member is movable between a position where the lock member is engaged with the tongue plate and a position where the engagement of the lock member and the tongue plate is released;

a release operating member which operates the lock member engaged with the tongue plate so as to move the lock member in an engagement releasing direction; and a mounting member to which said holding member is fixed and to which said release operating member is mounted in a slidable manner, wherein, before said holding member and said release operating member are assembled with said mounting member, said holding member and said release operating member are integrally connected via connecting portions, to thereby form a unit of buckle component members which can be mounted to said mounting member by sliding along an axis (A) with respect to said mounting member, and the connecting portions respectively include minimum sectional area portions which are each formed along a line which transversely intersects the axis (A) of the sliding direction of the unit of buckle component members.

11. A buckle according to claim 10, wherein said unit of buckle component members is formed so as to be symmertrical about a longitudinal-direction center line thereof.

12. A buckle according to claim 11, wherein the line along which the minimum sectional area portions are formed each intersect said sliding axis (A) of the unit of buckle component members at an angle of intersection in the range of 40 to 50 degrees so as to be disposed along a direction substantially perpendicular to tensile stress acting on said connecting portions due to the sliding of the unit of buckle component members.

13. A buckle according to claim 11, wherein said connecting portions by which said holding member and said release operating member are connected integrally include a first connecting portion positioned on the longitudinal-direction center line of said unit of buckle component members, a pair of second connecting portions provided at positions which are symmetrical about the center line, and a pair of third connecting portions provided at positions which are symmetrical about the center line.

14. A buckle according to claim 13, wherein a minimum sectional area portion of the first connecting portion is formed so as to face in a direction perpendicular to a direction in which said release operating member slides.

15. A buckle according to claim 13, wherein minimum sectional area portions of the second connecting portions are formed so as to face in a direction perpendicular to said axis (A) along which said release operating member slides.

16. A buckle according to claim 13, wherein minimum sectional area portions of the third connecting portions are provided to face in a direction which intersects, at a fixed angle of inclination, said axis (A) along which said release operating member slides.

17. A buckle according to claim 16, wherein the fixed angle of inclination is set so that the minimum sectional area portions of the third connecting portions are provided to face in a direction substantially perpendicular to tensile stress acting on the third connecting portions.

18. A buckle according to claim 17, wherein the fixed angle of inclination is 45 degrees.

* * * * *